US008328695B2

(12) United States Patent
Ronan et al.

(10) Patent No.: US 8,328,695 B2
(45) Date of Patent: Dec. 11, 2012

(54) TRAMPOLINE AND CAGE BALL GAME DEVICE

(76) Inventors: Devin J. Ronan, Temecula, CA (US); John S. Ronan, Temecula, CA (US)

( * ) Notice: Subject to any disclaimer, the term of this patent is extended or adjusted under 35 U.S.C. 154(b) by 58 days.

(21) Appl. No.: 12/926,630

(22) Filed: Dec. 1, 2010

(65) Prior Publication Data

US 2012/0142500 A1 Jun. 7, 2012

(51) Int. Cl.
*A63B 5/11* (2006.01)

(52) U.S. Cl. ..... 482/29; 472/94; 473/479; 473/490; 135/156

(58) Field of Classification Search ..... 482/23, 482/26–29; 472/92–94; 473/421, 465, 466, 473/472, 473, 490, 479, 482; 135/156, 157; D21/797
See application file for complete search history.

(56) References Cited

U.S. PATENT DOCUMENTS

| | | | | |
|---|---|---|---|---|
| 959,973 | A * | 5/1910 | Tomkins | 472/94 |
| 2,785,897 | A * | 3/1957 | Lennon | 472/94 |
| 2,847,017 | A * | 8/1958 | Drago | 135/157 |
| 3,201,126 | A | 8/1965 | Nissen | |
| 3,222,067 | A * | 12/1965 | Litwhiler et al. | 473/421 |
| 3,312,471 | A | 4/1967 | Nissen | |
| 4,433,838 | A | 2/1984 | Gordon | |
| 4,569,515 | A | 2/1986 | Gordon | |
| 4,890,834 | A * | 1/1990 | Ponza | 473/421 |
| D370,045 | S * | 5/1996 | Derbecker | D21/826 |
| 5,833,557 | A | 11/1998 | Cole | |
| 6,093,134 | A * | 7/2000 | Worsham | 482/35 |
| 6,135,922 | A * | 10/2000 | Nissen | 482/27 |
| 6,607,468 | B1 * | 8/2003 | Nichols et al. | 482/27 |
| 6,988,967 | B2 | 1/2006 | Allison | |
| 7,037,220 | B1 | 5/2006 | Gordon | |
| D570,947 | S * | 6/2008 | Horne | D21/797 |
| 7,481,740 | B2 | 1/2009 | Colling | |
| D614,715 | S * | 4/2010 | Mann | D21/797 |
| 7,762,927 | B1 * | 7/2010 | Gordon | 482/27 |
| 2009/0023558 | A1 | 1/2009 | VanElverdinghe | |

FOREIGN PATENT DOCUMENTS

| | | | |
|---|---|---|---|
| FR | 2623719 | A1 * | 6/1989 |
| WO | WO 2008126033 | A1 * | 10/2008 |

OTHER PUBLICATIONS

Merriam Webster's Collegiate Dictionary, 10th Edition, 1997, p. 452, definition of "fold".*

* cited by examiner

*Primary Examiner* — Loan Thanh
*Assistant Examiner* — Victor K Hwang
(74) *Attorney, Agent, or Firm* — Patent Analysis Research Technology Sys.; George L. Walton

(57) ABSTRACT

A trampoline and cage ball game device includes a trampoline frame structure with a spring supported flexible trampoline bed attached thereto and a plurality of support legs for supporting the trampoline frame and flexible bed. A single continuous open ended sheet of flexible material that is folded into four reinforced corners defining a pair of end wall panel sections and a pair of side wall end sections forming an enclosed cage structure. A plurality of elongated corner pipes are attached to inner corners of the trampoline extending beyond the top of the enclosed cage structure, the corner pipes having spring attachments secured to the four corner folds to stretch enclosed cage structure at the end wall sections. A plurality of upper horizontal pipes are cooperatively associated with each of the plurality of corner pipes and the intermediate elongated pipes for attaching a plurality of display banners to the top open end of the enclosed cage structure along the end wall panel sections and the side wall panel sections.

17 Claims, 12 Drawing Sheets

TRAMPOLINE AND CAGE BALL GAME DEVICE

CROSS REFERENCE TO RELATED APPLICATION(S)

NONE.

BACKGROUND OF THE INVENTION

1. Field of the Invention

The present invention relates to a game to be played by opposing teams or players while bouncing or jumping on a trampoline bed surface enclosed by a caged frame structure and rules for governing the same.

2. Description of the Related Art

Traditionally, the trampoline with a bed surface has been used for a variety of recreational and athletic purposes, such as jumping, exercising, performing acrobatic and gymnastic feats or stunts above the trampoline bed surface, and playing different types of games thereon. Many games have been played on trampoline bed surfaces with a net member stretched across it and being removably secured thereto, such as volleyball, basketball, soccer, badminton, to name just a few.

Prior art games have been created for play on a trampoline with a ball-type net suspended above the trampoline bed surface with a ball member being hit or thrown over the net by users or players to score or compete against one. Such prior art games are disclosed and described in U.S. Pat. Nos. 3,201,126, 3,312,471, 4,433,838, 4,569,515, 5,833,557, 6,988,967 and U.S. Publication No. 2009/0023558, to name just a few.

As a result of careless use of trampolines and poorly designed and manufactured structures, many personal injuries have occurred. Such injuries resulted from a user jumping to close to the edge of the trampoline bed surface and falling off, striking the fame, a tree, the ground, concrete surface, or another hard surface positioned proximate the trampoline's area or boundary. This has been a major concern for many trampoline enthusiasts and manufacturers.

In order to overcome the above injury concerns, trampolines have been designed and made with enclosed flexible fences, nets or framed caged structures that surround the perimeter of the trampoline's bed surface. In these types of enclosed trampolines, any user that plays or jumps on the trampoline bed surface will always be maintained on the bed surface and never fall off the edge and injure themselves. Likewise, because the enclosure is made of a flexible material, such as netting, mesh, or a framed caged structure, the enclosure will also prevent a user or player from harmfully impacting the trampoline's frame or other hard surfaces. In this manner, the enclosure will greatly increase the safety of the trampoline.

Furthermore, the trampoline with the enclosure allows users or players to play a variety of games using the enclosure and other equipment, such as balls, goals, nets, to name just a few. Accordingly, there is a need in the art for various trampoline games that interest older users and will include, for example, sports and sporting events.

Moreover, one disadvantage of trampolines is that they can take up large areas of space. Some sports and recreational activities, on the other hand, often require large open spaces, such as fields, courts, etc., in order to be played properly. People often can not play or practice sports in the same area as the trampoline for fear that the trampoline will interfere with the game.

It has often been recommended by trampoline manufacturers that only one person at a time should jump on the trampoline bed surface, while others await their turn. It would be a significant advancement in the art to provide a new, useful and exciting type of trampoline device, which permits a variety of other sports and recreational activities to be played or practiced in the same area while the trampoline is in use. Such a device is disclosed herein.

The disclosed invention provides a unique and improved ultimate trampoline cage and ball device that is much safer with a better designed and sturdier caged structure.

SUMMARY OF THE INVENTION

The present invention is a trampoline and ball caged structure game device in which one or more persons or players can participate in playing a particular type of game.

According to one aspect of the present invention there is provided a unique trampoline and caged ball game structure that includes a single conventional Olympic sized trampoline bed that is connected to a frame structure by a plurality of spring members. The trampoline bed is preferably made of recreational trampoline material, such as woven polypropylene. Also, the trampoline bed can be made from various other types of flexible materials such as, canvas, nylon and other similar woven-like fabrics. Preferably, the bed surface may comprise a single sheet of woven polypropylene or it may comprise a web woven of strips of such material, if desired. The frame structure has a pair of end sections and a pair of side sections. Each end sections and each side sections have a pair of spaced apart socket receiving portions mounted at an underneath portion thereof. Each socket portion can be secured by welding or bolting thereto. Other types of mechanical securing means may be utilized, if desired. Further, the frame structure includes four substantially U-shaped support legs having a pair of upper ends. One of the upper ends of each of the four legs is removably secured to one of the socket portions of the end sections and the other upper ends of the four legs are removably secured to the socket portions in the side sections. Once the legs are attached they are oriented at an angle relative to side and end sections. This orientation provides a sturdy balance relative to a ground surface.

According to another aspect of the present invention, the trampoline bed is enclosed by a stretched spring suspended cage structure with a preferred dimension of 12'×6'×12'. The cage structure is preferably made of a continuous open-ended sheet of the same material that the trampoline bed is made from, which is folded at four different areas defining four-cornered reinforced folds. Each of the reinforced corner folds of the continuous open-ended sheet forms a pair of end wall panel sections and a pair of side wall panel sections there between.

Also, the pair of side wall panel sections includes an intermediate reinforced stitched seam that runs substantially the entire length of the pair of side wall panel sections. The reinforced stitched seam has a plurality of spaced apart reinforced holes disposed therein.

The four-cornered folds are suspended by a plurality of selectively spaced springs with one end thereof connected to the four-cornered folds via a reinforced hole therein or connected to one end of an S-shaped hook with the other end being connected to the reinforced hole. The other ends of the plurality of selectively spaced springs are connected to a plurality of aligned and selectively spaced extending clamping tabs that are removably secured to a pair of elongated corner pipes or poles positioned opposite and extending away from the four-cornered folds and the end panel sections. Each of the elongated corner pipes has an upper end with an elbow joint attached thereto. A first horizontal pipe is removably secured between the elbow joints forming an arch structure. Equally spaced from the elbow joints are a pair of tee joints disposed on the first horizontal pipe to be discussed in greater detail later. The other end of the corner pipes have base plates removably secured thereto. These base plates have a plurality of fastening holes that receive a fastening bolt or member to secure the corner pipes to the aforementioned ground surface, preferably a concrete surface. Note that other types of ground surfaces could be utilized.

Additionally, the elongated corner pipes have an anchor element with an extension member with a fastening hole therein. The corner pipes are positioned at an inner corner portion of the frame structure and outward from the four-cornered folds. Also, the corner portions of the frame structure includes a clamp member with a fastening hole therein to align with fastening hole of the anchor element to receive a fastening member therein to secure the corner poles to and within the inner corner portions of the frame structure to stabilize the trampoline and cage ball structure. Note that the positioning of the corner pipes at a distance outward of the enclosed cage structure allows the selectively spaced springs to stretch the cage structure at the four-cornered folds to maintain the enclosed cage structure in an outward stretched manner to prevent the collapsing of the enclosed cage structure. At an intermediate location on each of the corner pipes an offset joint is removably attached thereto. This allows a second horizontal pipe to be attached between the corner pipes at one receiving end of the offset joints to further stabilize the arch structure.

According to another aspect of the present invention, a pair of intermediate elongated stabilizing pipes has the same dimensions as the above recited corner pipes. Each of the elongated intermediate pipes has an upper end with an elbow joint attached thereto. A third horizontal pipe is removably secured to the elbow joints forming an arch structure across the top and intermediate portions of the side wall panel sections. A pair of spaced apart three-way 45 degree joints having two open ends and an angled open end positioned at selected space locations on the third horizontal pipe for receiving the second horizontal pipe through the two open ends of the three-way 45 degree joints and a tee-joint disposed at an intermediate location on the third horizontal pipe between the pair of spaced apart three-way 45 degree joints. Also, the intermediate elongated pipes have a three-way 45 degree joint positioned below the elbow joints and a swivel joint positioned below the three-way 45 joint of the intermediate elongated pipes and in alignment with the removable offset joints on the corner pipes.

A fourth pair of horizontal pipes located on opposite sides of the side wall panel sections. One pair of the fourth horizontal pipes is located on opposite sides of the side wall panel sections with one end being connected to the other ends of the offset joints of the corner pipes and the other ends are connected to one end of the swivel joint on one side of the intermediate elongated pipes. The other pair of fourth horizontal pipes is located on opposite sides of the side panel sections with one end being connected to the other ends of the offset joints of the corner pipes and the other ends are connected to one end of the swivel joint on the other side of the intermediate elongated pipes. The selected and spaced distance of the intermediate elongated pipes from the trampoline frame and the position of the corner pipes within the corner sections of the frame structure causes the fourth pair of horizontal pipes to be oriented and extended at an angle away from the side wall panel sections about the swivel joints to achieve greater stability and balance of the trampoline and cage structure.

The other ends of the intermediate elongated pipes have base plates removably secured thereto. These base plates have a plurality of fastening holes that receive a fastening bolt or member to secure the intermediate elongated pipes to the aforementioned ground surface. The intermediate pipes extend outside of the trampoline frame structure at a spaced and selected distance there from. A plurality of selectively spaced springs having one end connected to the aforementioned intermediate reinforced seam and the other end is connected to one end of a plurality of aligned chain elements with the other end of the aligned chain elements being connected to a plurality of a selectively spaced extending clamping tabs that are removably secured to the pair of elongated intermediate pipes for stretching the side wall panel sections outward for maintaining the cage structure in a constant full-stretched condition. This alleviates the cage structure from collapsing inward.

A pair of reinforced stainless steel or fiberglass rods is inserted through spaced openings along the reinforced seams forming gaps between the rods and the seams for securing a regular 9 feet middle net across the enclosed 12'×6'×12' trampoline and caged ball game structure for dividing it into two equally 6'×6' sections. Note that the net can be adjustable to different heights or different height nets can be utilized, if desired. The net is tightened and secured by a plurality of Velcro fasteners disposed along and adjacent the opposite edges of the middle net. In order to tightened the middle net a first portion of the Velcro fastener is inserted in the gaps between rods and the reinforced seams. Then the first portion of the Velcro fastener is pulled around the rods to secure the first Velcro portion to a second Velcro portion for tightly securing the middle within the trampoline and caged ball game structure.

Furthermore, the spring ends connected to the reinforced seam can be connected directly in the plurality of reinforced spring holes or they can be directly connected to one end of an S-shaped hook or other types of mechanical fasteners with the other end of the S-shaped hook or other types of mechanical fasteners being directly connected to the reinforced spring holes.

A further aspect of the present invention includes a fifth pair of horizontal pipes disposed on opposite sides of the third horizontal pipe having a pair of ends. One end of the fifth pair of horizontal pipes are connected to the previously mentioned spaced apart tee joints on the first horizontal pipes and the other ends of the fifth pair of horizontal pipes are connected to opposite ends of a cross joint coupler that is in abutting engagement with the aforementioned three-way 45 degree joints disposed on the third horizontal pipe. A pair of tee joints is selectively positioned on the fifth pair of horizontal pipes and selectively spaced from and aligned with the tee joints on the first horizontal pipes. A sixth and separate horizontal pipe is disposed on opposite sides of the third horizontal pipe and perpendicular to the fifth horizontal pipes. Each sixth horizontal pipe has a pair of ends connected between the tee joints the fifth horizontal pipes.

The fifth and sixth horizontal pipes are selectively positioned and spaced directly above the top open end of the side wall panel sections and the end wall panel sections of the cage structure, respectively. Prior to connecting the fifth and sixth horizontal pipes display banners are slidably disposed on each fifth and sixth horizontal pipes. This selective positioning and spacing allow for the display banners to hang down just enough to be stitched to the top of the end wall panel sections and the side wall panel sections to permanently hold them in place. These display banners can be used for displaying the name of the trampoline and cage ball game device and other types of advertising, if desired. Note that a pair of display banners is positioned on opposite sides of the aforementioned cross joint couplers with a space being created by the width of the cross joint couplers adjacent the ends of each of the fifth horizontal pipes connected to the cross joint couplers.

Further, in regards to the intermediate elongated pipe, a brace support pipe is attached to the aforementioned three-way 45 degree joint located on the third horizontal pipe that abuts the cross joint coupler and the aforementioned three-way 45 degree joint disposed below the elbow joints at the top of the intermediate elongated pipes forming substantially a 45 degree triangle. Also, the brace support includes a removable three-way 45 degree joint that has a straight portion with a pair of open ends slidable along the brace support and an angular portion with an open end extending from the straight portion. This three-way 45 degree joint is selectively positioned between the three-way 45 degree joint on the third horizontal pipe that abuts the cross joint coupler and the three-way 45 degree joint disposed below the elbow joints at the top of the intermediate elongated pipes, but in closer proximity to the three-way 45 degree joint on the third horizontal pipe and the cross joint coupler. A first short pipe having a first end attached to an open end of the angular portion and the other end has an elbow joint attached thereto that receives one end of a second short pipe that substantially forms a 90 degree angle. The second short pipe extends upward into at least one of the aforementioned spaces created by the width of the cross joints and the ends of the display banners adjacent the cross joints.

The brace support pipes have a metal tab secured thereto and is in abutting engagement with the three-way 45 degree joint on the third horizontal pipe. This tab is secured to the brace support by screw means or other any other mechanical fastener means, if desired. These tabs have an extending portion with a hole therein for allowing pulleys to be attached to a harness so that a spotting training rig device can be easily attached and removed from, when the center net is removed. When the spotting training rig is used, the caged structure will protect and prevent the participants during training or recreational exercises from falling off the trampoline and cage ball game structure which normally would cause major injuries. This is one of the inventive features of the present invention over the prior art.

In accordance to another feature of the present invention includes a game display scoreboard. The scoreboard has a front surface and a rear surface. Note that the front face for example, can show a time clock display, a home team score display and a visitor team score display merely for illustration purposes. It is apparent that other display types, such as fouls or penalties, players' names and jersey numbers, periods or quarters, to name just a few, can be utilized as well, if desired. The rear surface includes a securing attachment that slides on the second short pipe within the at least one of the aforementioned spaces created by the width of the cross joints and the ends of the display banners adjacent the cross joints for tightly securing the scoreboard on the second short pipe. This securing attachment can take on various types of mechanical fastening means, if desired. As illustrated the scoreboard is equal to the height of the display banners. The scoreboard has a plastic case around it for protection. This can provide safety protection for players or participants and prevent damage to the scoreboard. The scoreboard is preferably operated by electrical power. However, the scoreboard could be wireless or battery operated, if desired. The power cord for the scoreboard is feed through a selective positioned hole in at least one of the intermediate elongated pipes above the base plate and upward through the elbow joint at the top end portion of the least one of the intermediate elongated poles and through the third horizontal pipe. The power cord is continued to be feed through the third horizontal pipe via the three-way 45 degree joint and along the brace support pipe and through the first and second short pipes to the scoreboard. Note that the power cord could be feed through the at least other one of the intermediate elongated pipe through a hole spaced above the base plate and into the other brace support pipe. The power cord is continued to be feed into the first short pipe extending from the brace support pipe and through the second short pipe attached to the first short pipe to the scoreboard, if desired. Other ways of feeding the power cord could be utilized, if desired.

In reference to another important feature of the present invention, a pair of goals, similar to basketball type goals is attached to the pair of sixth horizontal pipes via a pair of spaced intermediate tee joints having a straight portion with a pair of open ends that slides along the pair of sixth horizontal pipes. Each of the goals frame structure comprises a pair of pipe extensions having one end connected directly to the straight portion of the intermediate tees and the other perpendicular open end portion that forms the T-shape is attached to an upper open end of a three-way joint, a lower open end of the three-way joint is attached directly to an elongated U-shaped tubular pipe and the perpendicular open end portions of the three-way joints are attached to a first cross support pipe at its open ends. Also, spaced below the first cross support pipe is a pair of tee joints slidable and removably secured along the U-shaped tubular pipe that is connected to a second cross support pipe opposite open ends. From the bottom of a U-shape section of the tubular pipe up to the second cross support pipe forms a goal or hoop opening. As illustrated the goal frame structure is angled or slightly tilted downward.

Once the goal frame structures have been assembled, a backboard is attached to the first pair of pipe extensions and extending along the U-shaped tubular pipe downward to and just above the second cross support pipe. The backboard covers the entire U-shaped tubular pipe down to the second cross support pipe. If desired, the backboard can extend slightly beyond the U-shaped tubular pipe. The backboard is secured to the goal U-shaped tubular pipe downward to and just above the second cross support pipe by screw means or any other mechanical fastening means, if desired.

A goal or hoop net having a rim portion that is secured about the U-shape section and a flap or extension portion secured about the second cross support pipe. Note that the net portions can be stitched thereon or they can be removably snapped therein, to name just a few ways to attach the net about the goal or hoop opening. It is apparent that various other ways of attaching the net to the U-shaped section and the second cross support pipe can be utilized, if desired.

Another important feature of the present invention includes a lighting fixture that is attached directly to the aforementioned intermediate tee joint located on the third horizontal pipe to provide adequate lighting to the two equally 6'×6' sections of the enclosed trampoline and cage ball game device divided by the previously discussed middle net during night-time participation. Note that the lighting fixture could be electrically or battery operated Finally, the pipes are preferably made of strong aluminum materials. However, other types of materials such as different types of plastics and metals, such as steel, to name just a few could be utilized, if desired. In reference to the U-shaped tubular goal structure, it can be made from a flexible plastic tubing or spa hose covered with a padded neoprene for safety purposes.

These and other features, aspects and advantages of the present will become better understood with regard to the following description, appended claims and accompanying drawings.

BRIEF DESCRIPTION OF THE DRAWINGS

The present invention may be better understood, along with its numerous objects, features, and advantages made apparent to those skilled in the art by referencing the accompanying drawings.

DETAILED DESCRIPTION

Reference will now be made in detail to the preferred embodiments of the invention, examples of which are illustrated in the accompanying drawings. While the invention will be described in conjunction with the accompanying drawings, it will be understood that they are not intended to limit the invention to the accompanying drawings. On the contrary, the present invention is intended to cover alternatives, modifications and equivalents, which may be included within the spirit and scope of the invention as defined by the appended claims.

Figure 1:
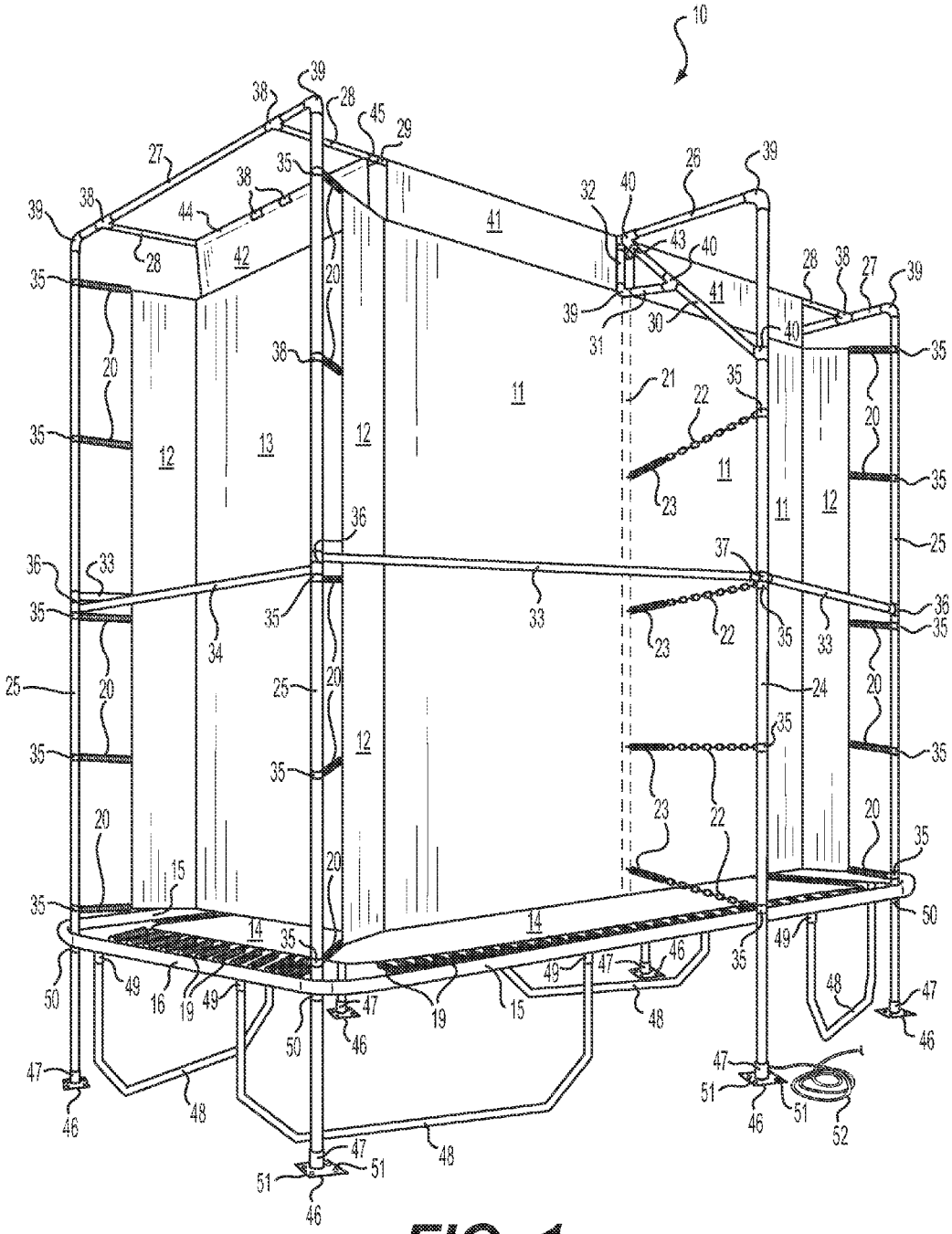
FIG. 1 illustrates an isometric view of a trampoline and cage ball game device according to the present invention.

FIG. 1 of the present invention shows a trampoline and ball cage structure game device 10 in which one or more persons or players can participate in playing a particular type of game. The trampoline and ball cage structure game device 10 includes a single conventional Olympic sized trampoline bed 14 that is connected to a frame structure 15, 16 by a plurality of spring members 19. The trampoline bed 14 is preferably made of recreational trampoline material, such as woven polypropylene. Also, the trampoline bed 14 can be made from various other types of flexible materials such as, canvas, nylon and other similar woven-like fabrics. Preferably, the bed 14 may comprise a single sheet of woven polypropylene or it may comprise a web woven of strips of such material, if desired. The frame structure 15, 16 has a pair of end sections 16 and a pair of side sections 15. Each end sections 16 and each side sections 15 have a pair of spaced apart socket receiving portions 49 mounted at an underneath portion thereof. Each socket portion 49 can be secured by welding or bolting thereto. Other types of mechanical securing means may be utilized, if desired. Further, the frame structure 15, 16 includes four substantially U-shaped support legs 48 having a pair of upper ends. One of the upper ends of each of the four legs 48 is removably secured to one of the socket portions 49 of the end sections 16 and the other upper ends of the four legs 48 are removably secured to the socket portions 49 in the side sections 15. Once the legs 48 are attached they are oriented at an angle relative to side and end sections 15, 16. This orientation provides a sturdy balance relative to a ground surface.

Also, the trampoline bed 14 is enclosed by a stretched spring suspended cage structure 11, 12, 13 with a preferred dimension of 12'×6'×12'. The cage structure 11, 12, 13 is preferably made of a continuous open-ended sheet of the same material that the trampoline bed 14 is made from, which is folded at four different areas defining four-cornered reinforced folds 12. Each of the reinforced corner folds 12 of the continuous open-ended sheet 11, 12, 13 forms a pair of end wall panel sections 13 and a pair of side wall panel sections 11 there between. The pair of side wall panel sections 11 includes an intermediate reinforced stitched seam 21 that runs substantially the entire length of the pair of side wall panel sections 11. Also, the reinforced stitched seam 21 has a plurality of spaced apart reinforced holes disposed therein which will be described and shown in greater detail later.

Figure 6:
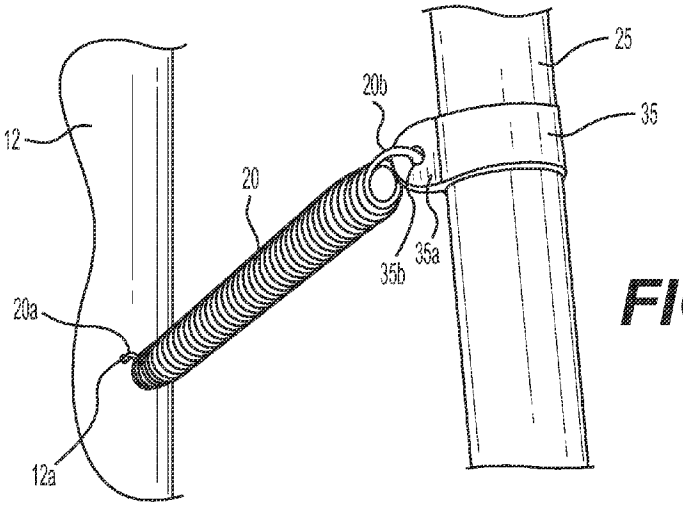
FIG. 6 illustrates a cutaway view of the elongated corner pipes with an extending spring tab for connecting support springs directly to a corner fold according to the present invention.
Figure 7:
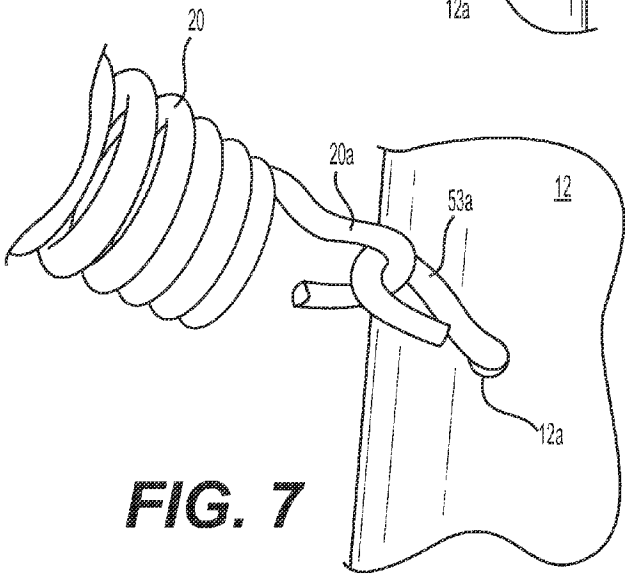
FIG. 7 illustrates a cutaway view of the connecting support springs being connected directly to one end of a S-shaped hook with the other end being connected directly to a corner fold according to the present invention.

Note that the four-cornered folds 12 are suspended by a plurality of selectively spaced springs 20 with one end thereof connected to the four-cornered folds 12. The other ends of the plurality of selectively spaced springs 20 are connected to a plurality of aligned and selectively spaced clamping tabs 35 that are removably secured to a pair of elongated corner pipes 25 positioned opposite and extending away from the four-cornered folds 12 and the end panel sections 13. The plurality of spaced springs 20 includes a first end 20*a* secured directly within securing holes 12*a* of the plurality of four-cornered folds 12 and a second end 20*b* secured within a securing holes 35*b* disposed within an end portion 35*a* of the plurality of clamping tabs 35 (See FIG. 6). Optionally, the first ends 20*a* can be connected to one end of an S-shaped hook member 53*a*, while the other end thereof is directly connected into the plurality of securing holes 12*a* of the four-corned folds 12 for a stronger and more reliable connection (See FIG. 7). Each of the elongated corner pipes 25 has an upper end with an elbow joint 39 attached thereto. A first horizontal pipe 27 is removably secured between the elbow joints forming an arch structure. Equally spaced from the elbow joints 39 are a pair of tee joints 38 disposed on the first horizontal pipe to be discussed in greater detail later. The other end of the corner pipes 25 are removably attached to base plates 46 within an extension portion 47 extending upward there from. Also, base plates 46 have a plurality of fastening holes 51 that receive a fastening bolt or member (not shown) to secure the corner pipes 25 to the aforementioned ground surface, preferably a concrete surface. Note that other types of ground surfaces could be utilized.

Figure 18:
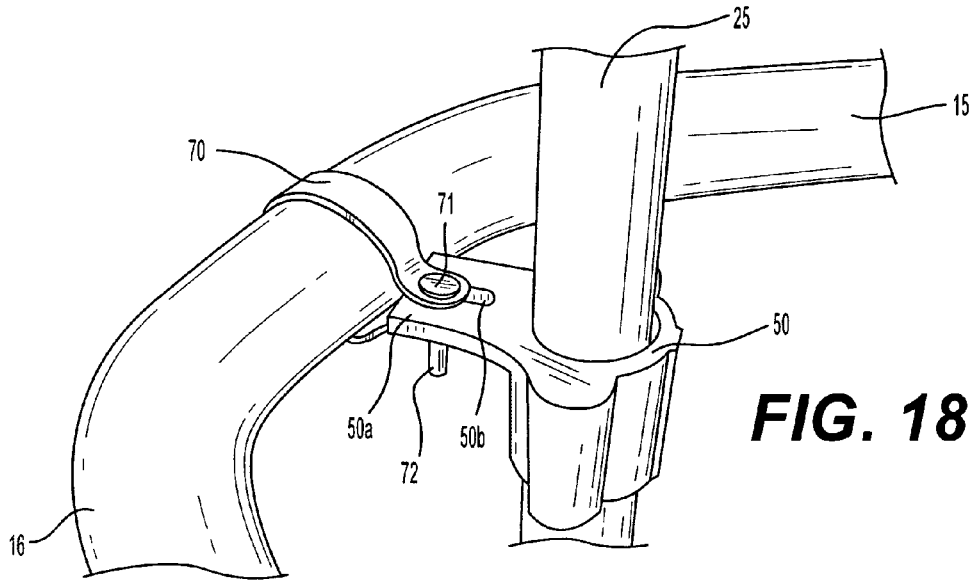
FIG. 18 illustrates a cutaway isometric view of a corner support pipe with an anchor coupler device with fastening means for securing the corner support pipe to the trampoline frame structure according to the present invention.
Figure 19:
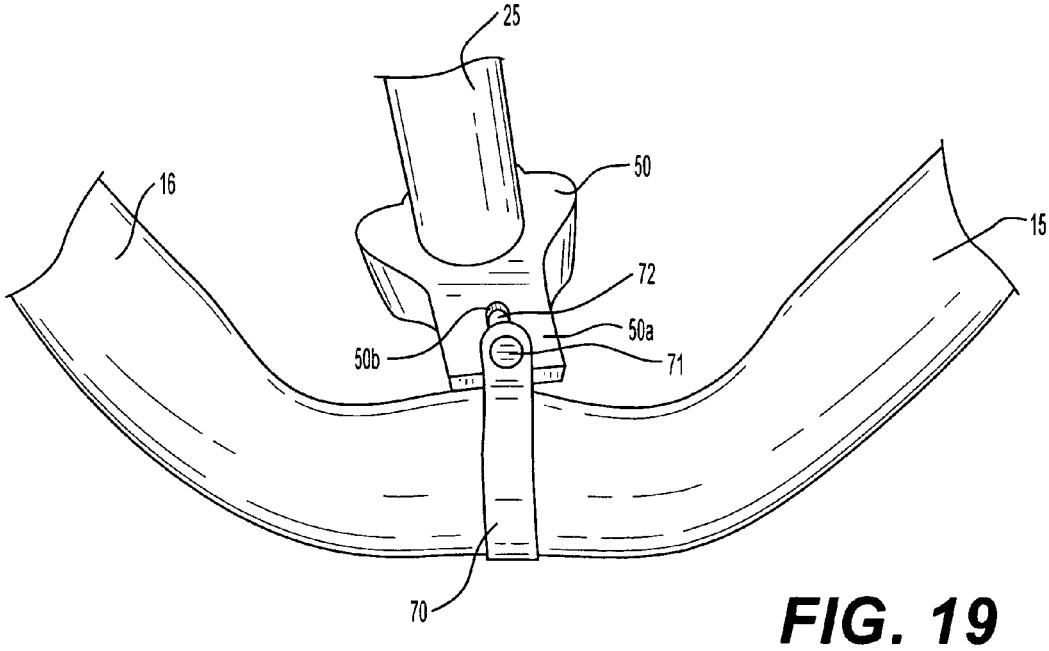
FIG. 19 illustrates a cutaway perspective front view of a corner support pipe with an anchor coupler device with fastening means for securing the corner support pipe to the trampoline frame structure according to the present invention.

In addition, the elongated corner pipes 25 have an anchor element 50 (shown in greater detail in FIGS. 18 and 19) with an extension member 50*a* (shown in greater detail in FIGS. 18 and 19) with a fastening hole 50*b* (shown in greater detail in FIGS. 18 and 19) therein. The corner pipes 25 are positioned at an inner corner portion of the frame structure 15, 16 and outward from the four-cornered folds 12. Also, the corner portions of the frame structure 15, 16 includes a clamp member 70 (shown in greater detail in FIGS. 18 and 19) with a fastening hole (not shown) therein to align with fastening hole 50*b* (shown in greater detail in FIGS. 18 and 19) of the anchor element 50 (shown in greater detail in FIGS. 18 and 19) to receive a fastening member having a head portion 71 and a leg portion 72 (shown in greater detail in FIGS. 18 and 19) therein to secure the corner pipes to and within the inner corner portions of the frame structure 15, 16 to stabilize the trampoline and cage ball structure 10. Preferably, the leg portion can include threads thereon to receive a tightening nut (not shown). However, the head 71 and the leg portion 72 can be selected from other types of fastening devices that are well known in the art. Note that the positioning of the corner pipes 25 at a distance outward of the enclosed cage structure allows the selectively spaced springs 20 to stretch the cage structure 10 at the four-cornered folds 12 to maintain the enclosed cage structure 10 in an outward stretched manner to prevent the collapsing thereof. At an intermediate location on each of the corner pipes 25 an offset joint 36 is removably attached thereto. This allows a second horizontal pipe 34 to be attached between the corner pipes 25 at one receiving end of the offset joints 36 to further stabilize the arch structure.

Still referring to the present invention, a pair of intermediate elongated stabilizing pipes 24 has the same dimensions as the above recited corner pipes 25. Each of the elongated intermediate pipes 24 has an upper end with an elbow joint 39 attached thereto. A third horizontal pipe 26 is removably secured to the elbow joints 39 forming an arch structure across the top and intermediate portions of the side wall panel sections 11. A pair of spaced apart three-way 45 degree joints 40 having two open ends and an angled open end positioned at selected space locations on the third horizontal pipe for receiving the third horizontal pipe through the two open ends of the three-way 45 degree joints 40 and a tee-joint 38 (not shown) disposed at an intermediate location on the third horizontal pipe 26 between the pair of spaced apart three-way 45 degree joints 40. Also, the intermediate elongated pipes 24 have a three-way 45 degree joint 40 positioned below the elbow joints 39 and a swivel joint 37 positioned below the three-way 45 joint of the intermediate elongated pipes and in alignment with the removable offset joints 36 on the corner pipes 25.

Figure 9:
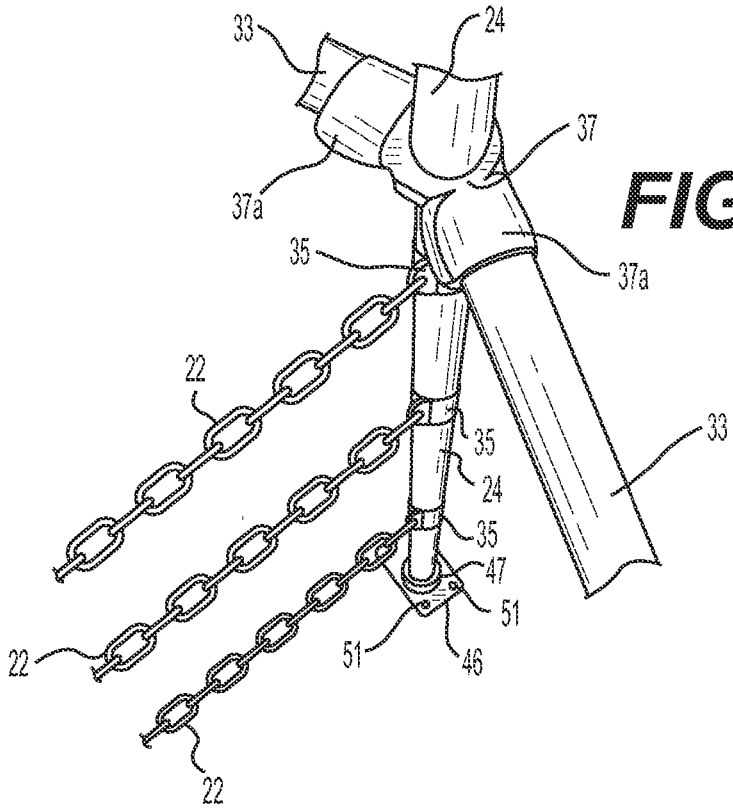
FIG. 9 illustrates a cutaway isometric view of an intermediate elongated pipe with a swivel joint that is connected to a pair of fourth angled horizontal pipes with a plurality of spring support chains attached to a plurality of extending spring tabs secured to the intermediate elongated pipe of the present invention.
Figure 10:
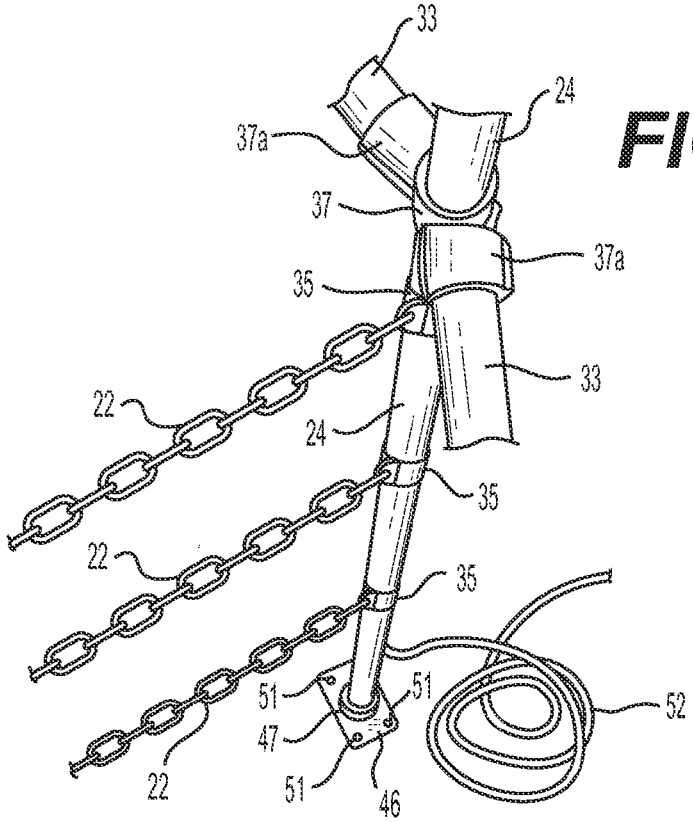
FIG. 10 illustrates another cutaway isometric view of an intermediate elongated pipe with a swivel joint that is connected to a pair of fourth angled horizontal pipes with a plurality of spring support chains attached to a plurality of extending spring tabs secured to the intermediate elongated pipe and a power cord of the present invention.
Figure 11:
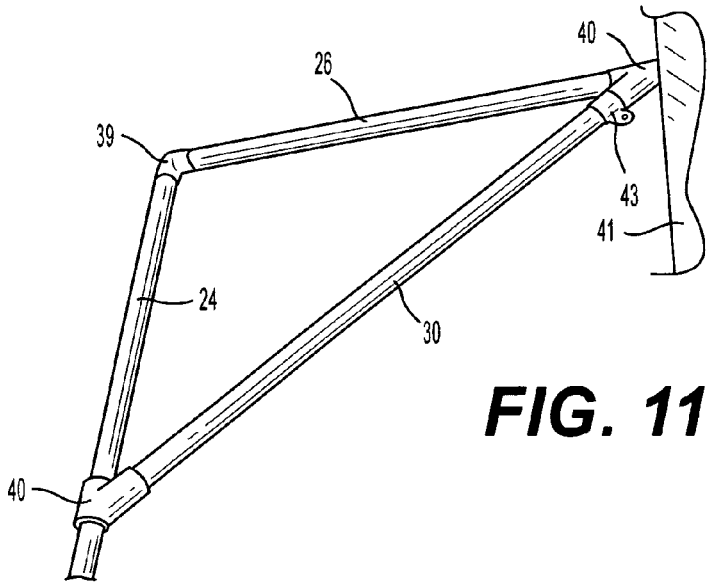
FIG. 11 illustrates a cutaway isometric view of a third horizontal pipe connected to a intermediate elongated pipe with a brace support pipe connected between the third horizontal pipe and the intermediate elongated pipe that is in relationship with a display banner of the present invention.

Referring to FIGS. 1-5, a fourth pair of horizontal pipes 33 are positioned on opposite sides of the side wall panel sections 11. One pair of the fourth horizontal pipes 33 is located on opposite sides of the side wall panel sections 11 with one end being connected to the other ends of the horizontal pipes 33 of the offset joints 36 of the corner pipes 25 and the other ends are connected to one end 37*a* of the swivel joint 37 on one side of the intermediate elongated pipes 24. The other pair of fourth horizontal pipes 33 is located on opposite sides of the side panel sections 11 with one end being connected to the other ends of the offset joints 36 of the corner pipes 25 and the other ends of the horizontal pipes 33 are connected to the other end 37*a* of the swivel joint 37 on the other side of the intermediate elongated pipes 24. Note that FIGS. 9 and 10 illustrate the swivel joint within the afore-mentioned ends 37*a*. The selected and spaced distance of the intermediate elongated pipes 24 from the trampoline frame 15, 16 and the position of the corner pipes 25 within the corner sections of the frame structure 15, 16 causes the fourth pair of horizontal pipes 33 to be oriented and extended at an angle away from the side wall panel sections 11 about the swivel joints 37 to achieve greater stability and balance of the trampoline and cage structure 10.

Figure 8:
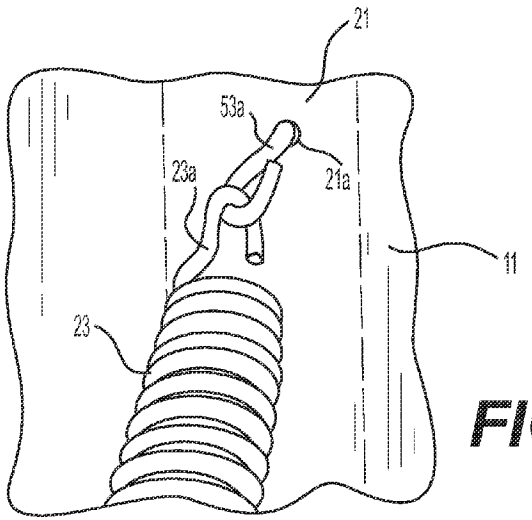
FIG. 8 illustrates a cutaway side view of connecting support springs that are connected directly to one end of an S-shaped hook with the other end being connected directly to a reinforced intermediate seam along an intermediate surface of the side wall panel sections of the present invention.

In FIGS. 1-5, the other ends of the intermediate elongated pipes 24 are removably attached to base plates 46 within an extension portion 47 extending upward there from. Also, base plates 46 have a plurality of fastening holes 51 that receive a fastening bolt or member (not shown) to secure the intermediate elongated pipes 24 to the aforementioned ground surface. The intermediate pipes 24 extend outside of the trampoline frame structure 15, 16 at a spaced and selected distance there from. A plurality of selectively spaced springs 23 having one end connected to the aforementioned intermediate reinforced seam 21 and the other end is connected to one end of a plurality of aligned chain elements 22 with the other end of the aligned chain elements 22 being connected to a plurality of a selectively spaced extending clamping tabs 35 that are removably secured to the pair of elongated intermediate pipes 24 for stretching the side wall panel sections 11 outward for maintaining the cage structure 10 in a constant full-stretched condition. In FIG. 8, the plurality of selectively spaced springs 23 includes a first end 23*a* secured directly within securing holes 21*a* of the intermediate reinforced seam 21 (See FIGS. 1-5) and a second end (similar to 20*b* of FIG. 6) secured within a securing hole (similar to 35*b* of FIG. 6) disposed within an end portion (similar to 35*a* of FIG. 6) of the plurality of clamping tabs 35 (See FIG. 6). Optionally, the first ends 20*a* can be connected to one end of an S-shaped hook member 53*a*, while the other end thereof is directly connected into the plurality of securing holes 21*a* of the intermediate reinforced seam 21 for a stronger and more reliable connection (See FIG. 8). This alleviates the cage structure 10 from collapsing inward.

Figure 13:
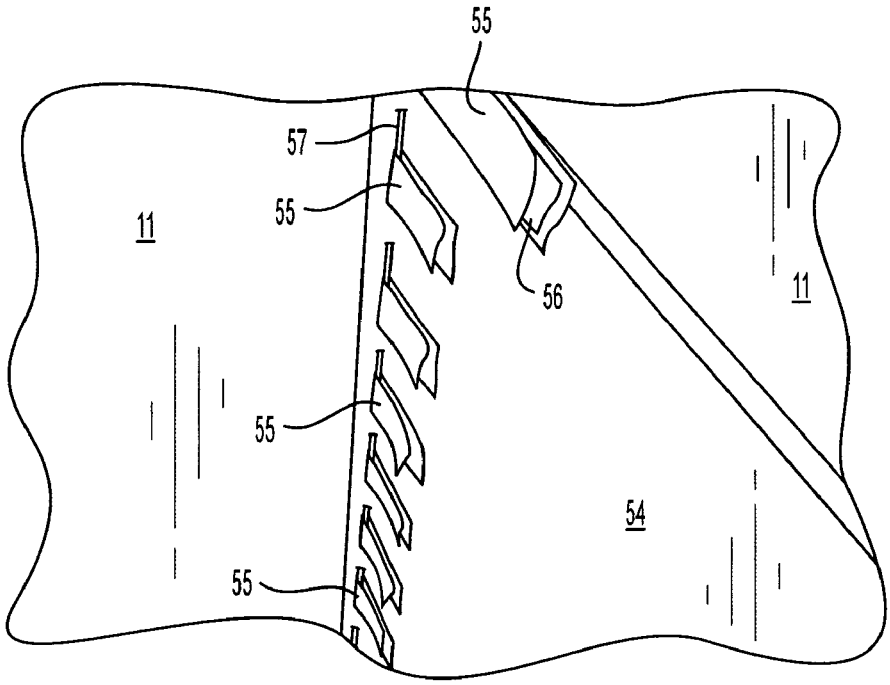
FIG. 13 illustrates a cutaway isometric view of a middle net with Velcro fasteners disposed within an enclosed trampoline and cage ball game structure of the present invention.
Figure 14:
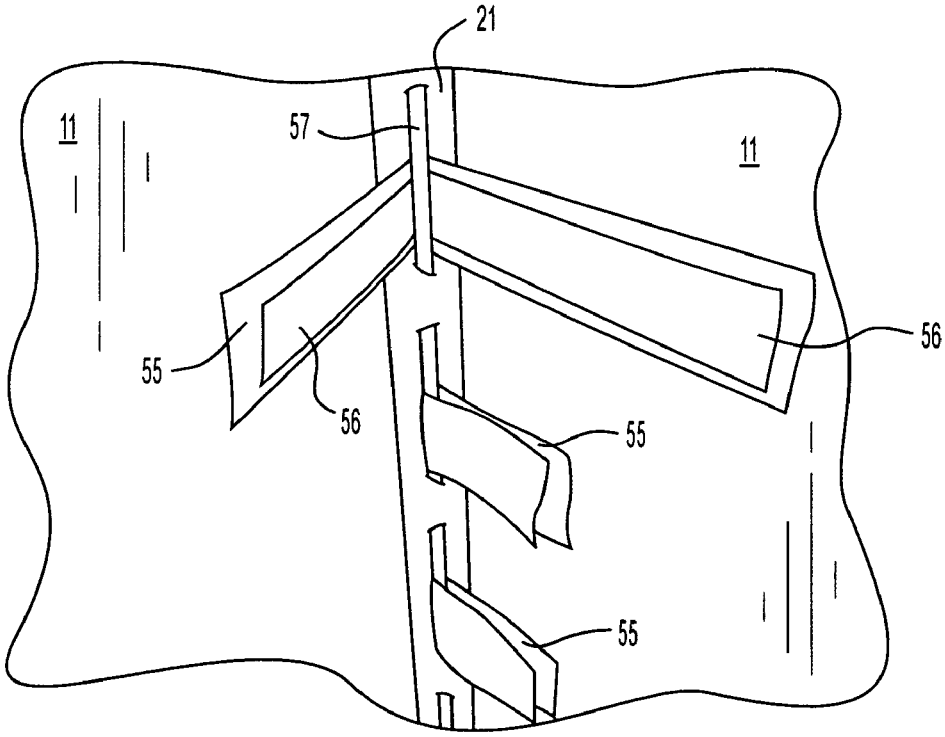
FIG. 14 illustrates a cutaway isometric view of a middle net with Velcro fasteners disposed about a reinforcing rod along a reinforced stitched seam on an inner intermediate portion of a side wall panel section within an enclosed trampoline and cage ball game structure of the present invention.

In reference to FIGS. 13 and 14, a pair of reinforced stainless steel or fiberglass rods 57 is inserted through spaced openings along the reinforced seams 21 forming gaps between the rods 57 and the seams 21 for securing a regular 9 feet middle net 54 across the enclosed 12'×6'×12' trampoline and caged ball game structure 10 for dividing it into two equally 6'×6' sections. Note that the net 54 can be adjustable to different heights or different height nets can be utilized, if desired. The net 54 is tightened and secured by a plurality of hook and loop type fasteners 55, 56, such as VELCRO, are disposed along and adjacent the opposite edges of the middle net 54. In order to tightened the middle net 54 a first portion of the hook and loop type fastener 55 (VELCRO) is inserted in the gaps between rods 57 and the reinforced seams 21. Then the first portion of the hook and loop type fastener 55 (VELCRO) is pulled around the rods 57 to secure the first hook and loop type fastener 55 (VELCRO) to a second hook and loop type fastener 56 (VELCRO) for tightly securing the middle net 54 within the trampoline and caged ball game structure 10. Note that various other types of fastening devices could be utilized, if desired.

As shown in FIG. 8, the spring ends 23*a* connected to the reinforced seam 21 can be connected directly in the plurality of reinforced spring holes 21*a* or they can be directly connected to one end of an S-shaped hook 53*a* or other types of mechanical fasteners with the other end of the S-shaped hook 53*a* or other types of mechanical fasteners being directly connected to the reinforced spring holes 21*a*.

Figure 2:
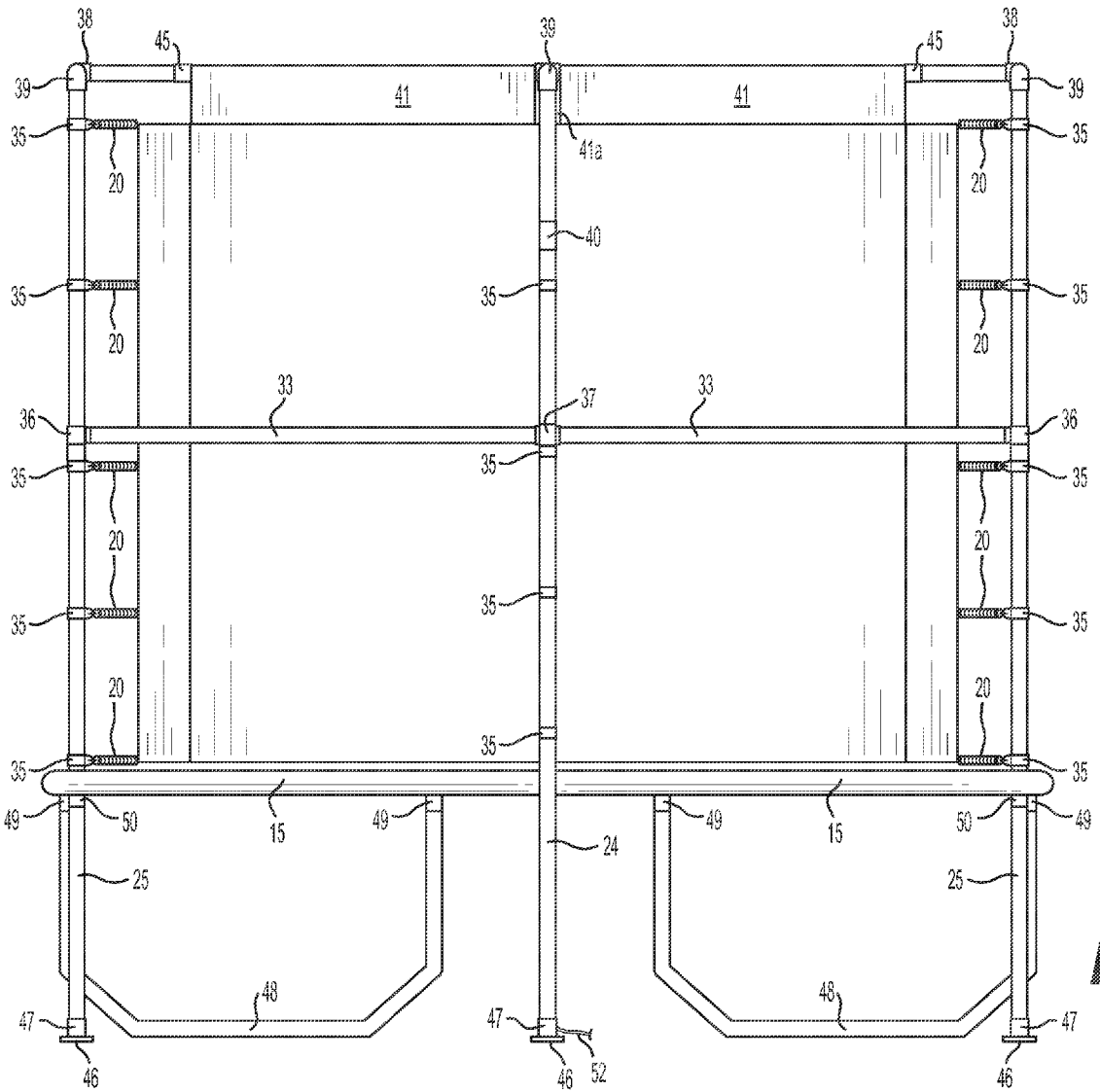
FIG. 2 illustrates a side view of the trampoline and cage ball game device according to the present invention.
Figure 3:
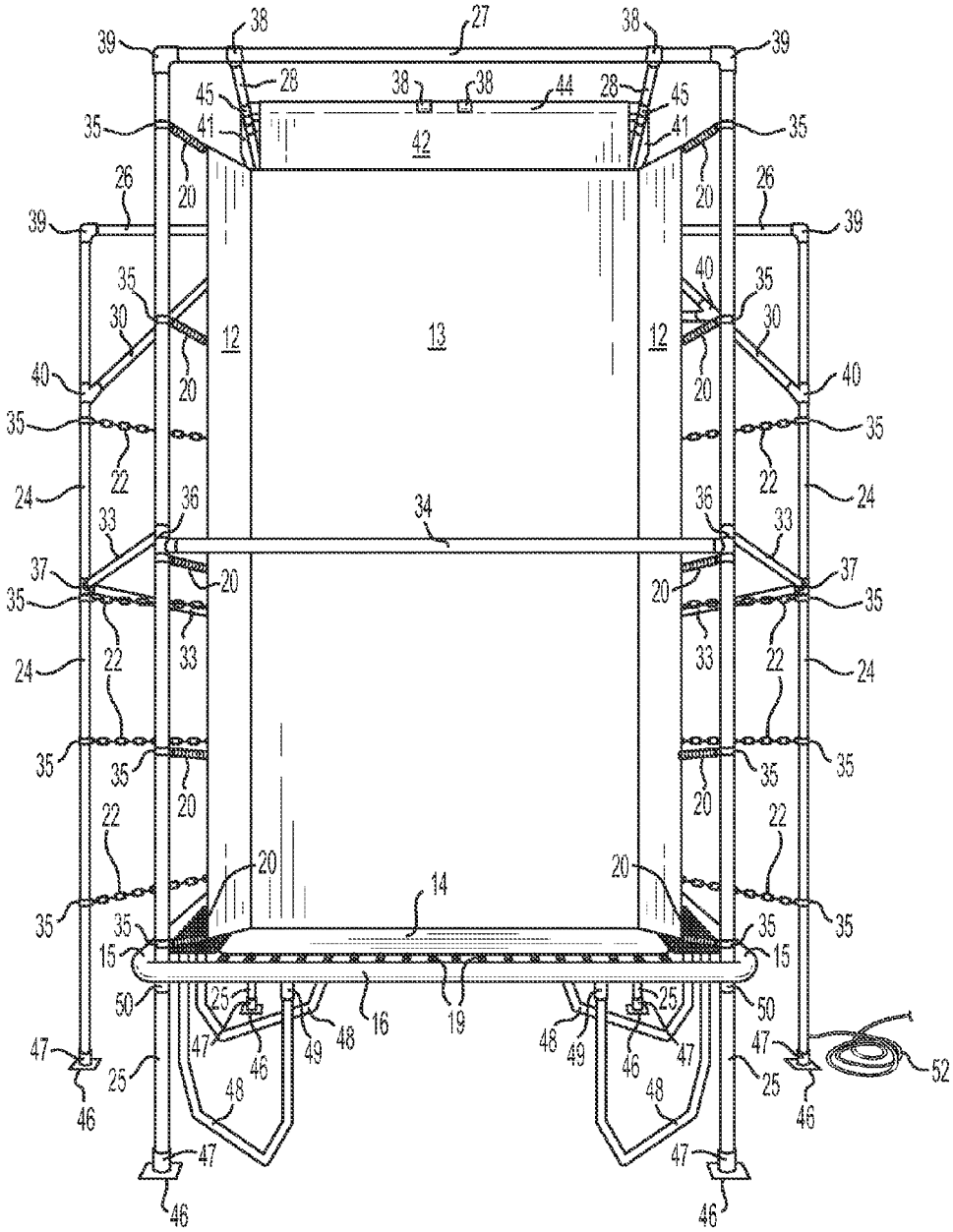
FIG. 3 illustrates an end view of the trampoline and cage ball game device of the present invention.
Figure 4:
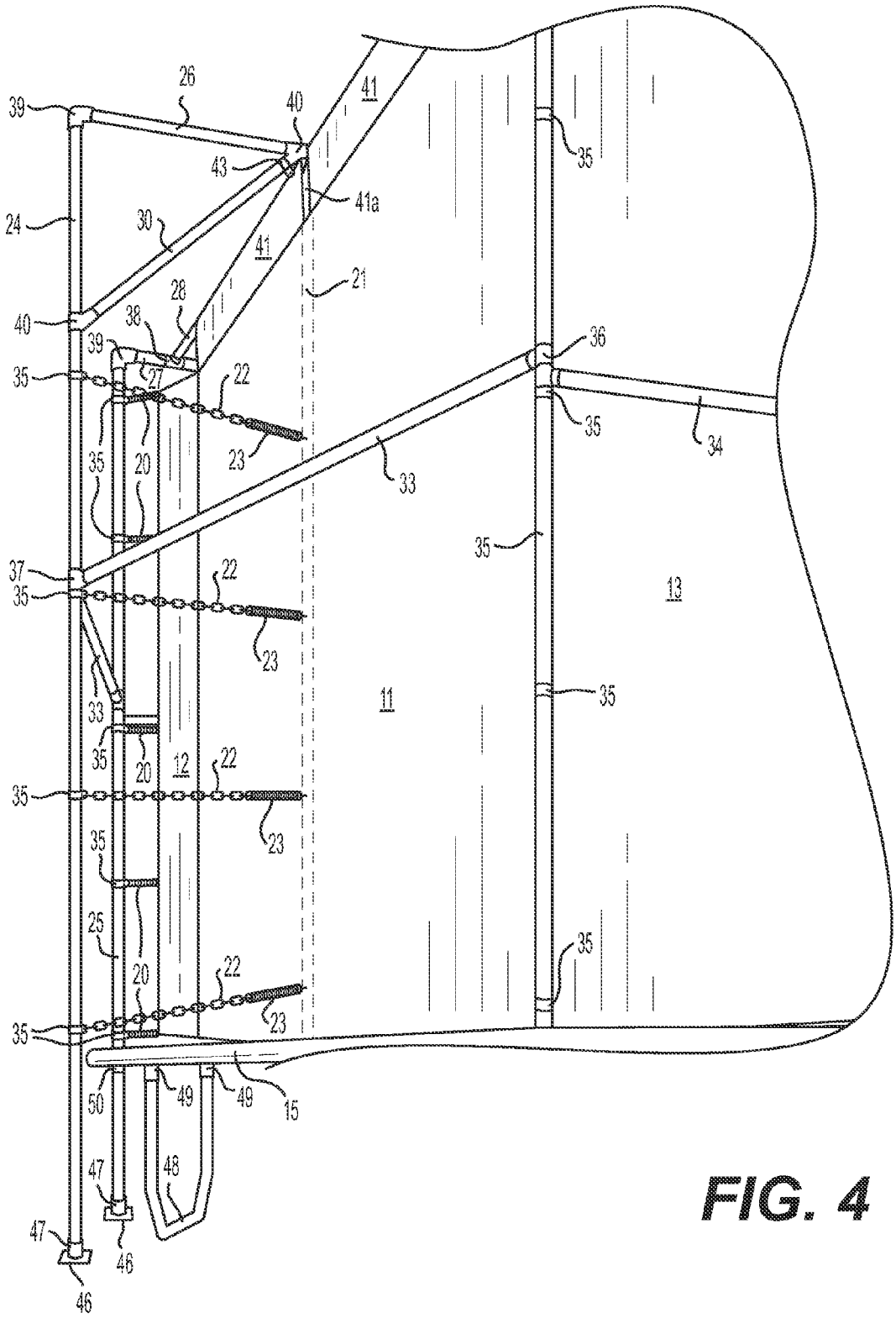
FIG. 4 illustrates a partial isometric side view of the trampoline and cage ball game device of the present invention.
Figure 5:
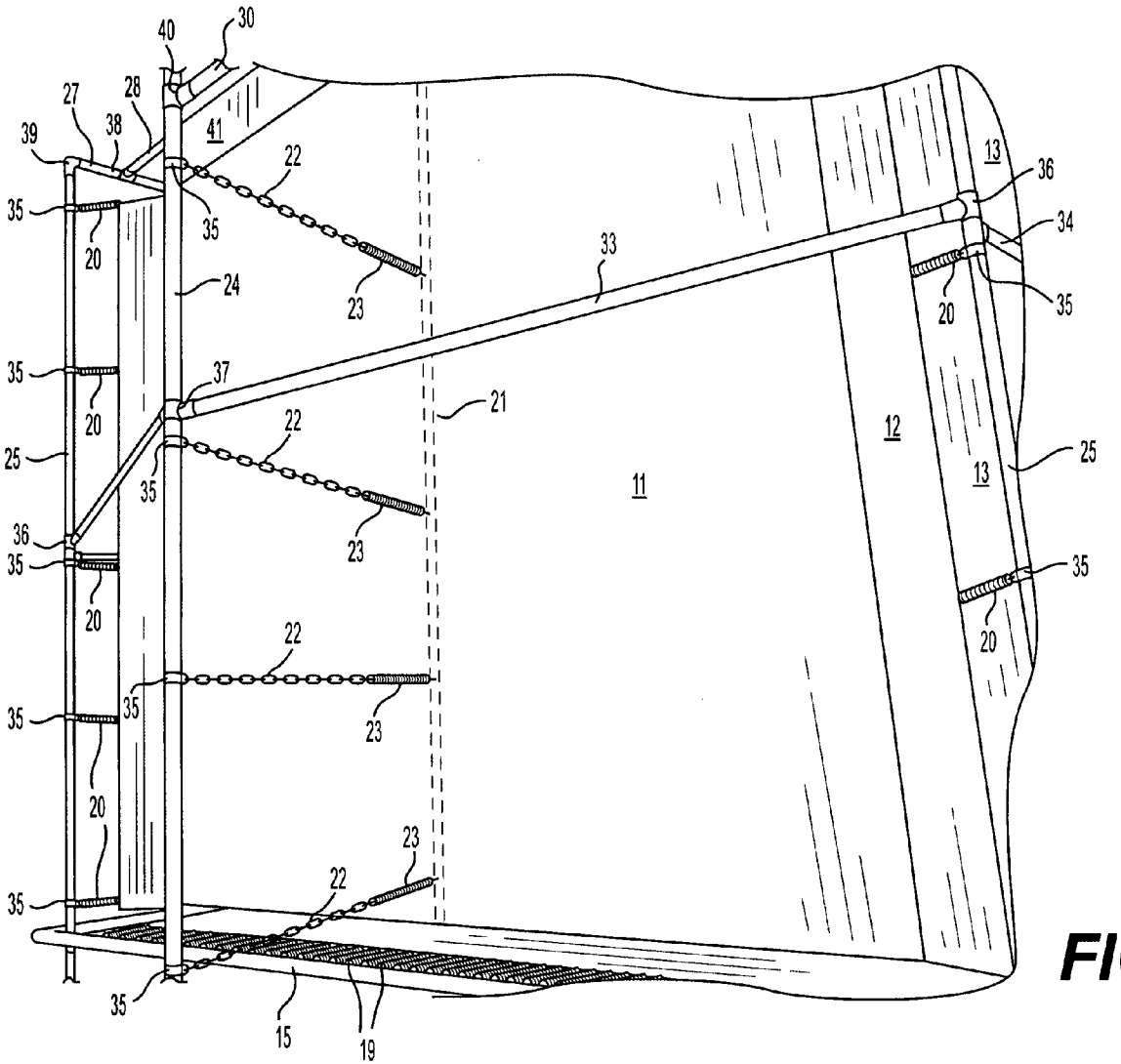
FIG. 5 illustrates another partial isometric side view of the trampoline and cage ball game device of the present invention.

Noting particularly to FIGS. 1-5 and 12, the present invention further includes a fifth pair of horizontal pipes 28 disposed on opposite sides of the third horizontal pipe 26 having a pair of ends. One end of the fifth pair of horizontal pipes 28 are connected to the previously mentioned spaced apart tee joints 38 on the first horizontal pipes 27 and the other ends of the fifth pair of horizontal pipes 28 are connected to opposite ends of a cross joint coupler 53 (see FIG. 12 for more details) that is in abutting engagement with the aforementioned three-way 45 degree joints 40 disposed on the third horizontal pipe 26. A pair of tee joints 45 is selectively positioned on the fifth pair of horizontal pipes 28 and selectively spaced from and aligned with the tee joints 38 on the first horizontal pipes 27. In FIGS. 1-3, a sixth and separate horizontal pipe 44 is disposed on opposite sides of the third horizontal pipe 26 and perpendicular to the fifth horizontal pipes 28. Each sixth horizontal pipe 44 has a pair of ends connected between the tee joints 45 of the fifth horizontal pipes 28.

Referring to FIGS. 1-5, and 12, the fifth horizontal pipes 28 and the sixth horizontal pipe 44 are selectively positioned and spaced directly above the top open end of the side wall panel sections 11 and the end wall panel sections 13 of the cage structure 10, respectively. Prior to connecting the fifth horizontal pipe 28 and the sixth horizontal pipe 44, display banners 41, 42 are slidably disposed on each of the fifth and sixth horizontal pipes 28, 44. This selective positioning and spacing allow for the display banners to hang down just enough to be stitched to the top of the end wall panel sections 13 and the side wall panel sections 11 to permanently hold them in place. These display banners 41, 42 can be used for displaying the name of the trampoline and cage ball game device 10 and other types of advertising, if desired. Note that a pair of display banners 41 is positioned on opposite sides of the aforementioned cross joint couplers 53 with a space being created by the width of the cross joint couplers 53 adjacent the ends of each of the fifth horizontal pipes 28 that are connected to the cross joint couplers 53. The banners are made preferably of polypropylene material. However, various other types of materials could be utilized, if desired.

In regards to FIGS. 1-4, 11 and 12, the intermediate elongated pipe 24 is connected to a brace support pipe 30 that is attached to the aforementioned three-way 45 degree joint 40 located on the third horizontal pipe 26 that abuts the cross joint coupler 53 and the aforementioned three-way 45 degree joint 40 disposed below the elbow joints 39 at the top of the intermediate elongated pipes 24 forming substantially a 45 degree triangle. Also, the brace support 30 includes a removable three-way 45 degree joint 40 that has a straight portion with a pair of open ends slidable along the brace support pipe 30 and an angular portion with an open end extending from the straight portion. This three-way 45 degree joint 40 is selectively positioned between the three-way 45 degree joint 40 on the third horizontal pipe 26 that abuts the cross joint coupler 53 and the three-way 45 degree joint 40 disposed below the elbow joints 39 at the top of the intermediate elongated pipes 24, but in closer proximity to the three-way 45 degree joint 40 on the third horizontal pipe 26 and the cross joint coupler 53. A first short pipe 31 having a first end attached to an open end of the angular portion and the other end has an elbow joint 39 attached thereto that receives one end of a second short pipe 32 that substantially forms a 90 degree angle. The second short pipe 32 extends upward into at least one of the aforementioned spaces 41*a* created by the width of the cross joints 53 and the ends of the display banners 41 adjacent the cross joints 53.

Figure 12:
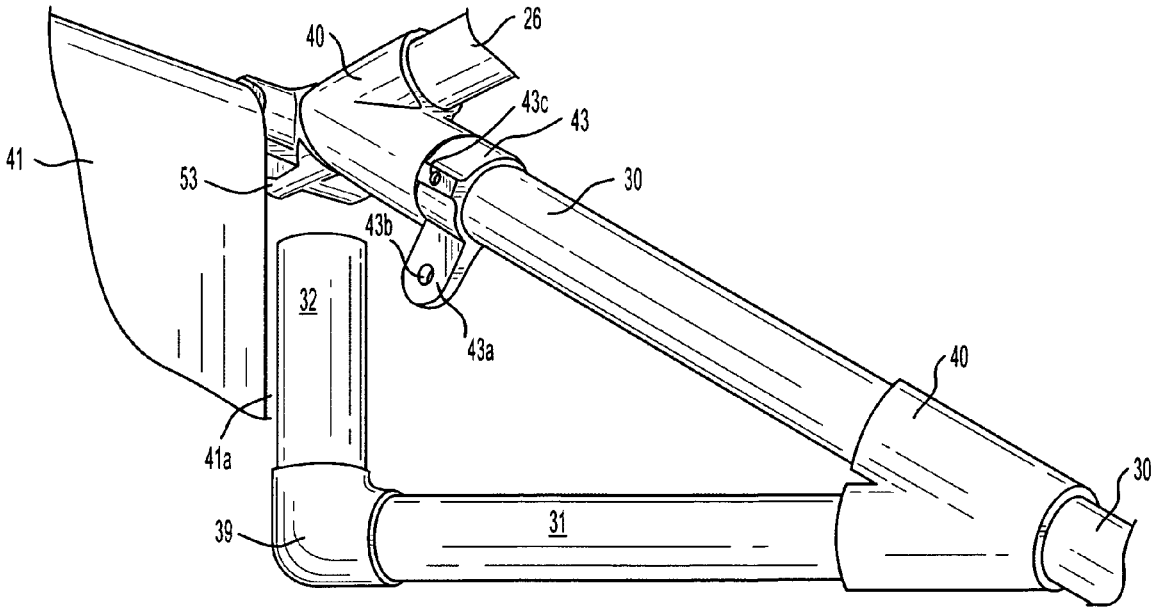
FIG. 12 illustrates a cutaway isometric view of another third horizontal pipe connected to another intermediate elongated pipe with another brace support pipe connected between the third horizontal pipe and the intermediate elongated pipe via three-way 45 degree joints with a first short pipe connected to the brace support pipe and second short pipe connected to the first pipe forming a right angle, and extending into a space created by a pair of display banners and a cross joint there between for attaching a scoreboard of the present invention.

In view of FIGS. 1 and 12, the brace support pipes 30 have a metal tab 43 secured thereto and is in abutting engagement with the three-way 45 degree joint 40 on the third horizontal pipe 26. This tab 43 is secured to the brace support 30 by screw means 43*c* or other any other mechanical fastener means, if desired. These tabs 43 have an extending portion 43*a* with a hole 43*b* therein for allowing pulleys (not shown) to be attached to a harness (not shown) so that a spotting training rig device can be easily attached and removed there from, when the center net is removed. When the spotting training rig is used, the caged structure 10 will protect and prevent the participants during training or recreational exercises from falling off the trampoline and cage ball game structure 10 which normally would cause major injuries. This is one of the inventive features of the present invention that is definitely not shown in the prior art.

Figure 15:
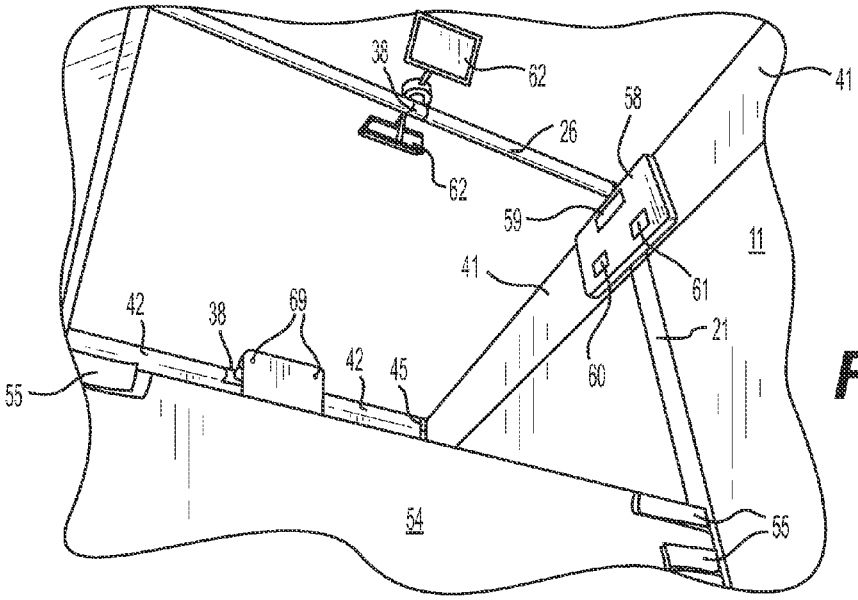
FIG. 15 illustrates a cutaway isometric view of a middle net, a light fixture attached to the third horizontal pipe, a scoreboard attached and positioned at the same height as the display banners above the intermediate reinforced seam of a side wall panel section and the middle net and a partial view of a backboard of a goal disposed along a display banner above an end wall panel section within an enclosed trampoline and cage ball game structure of the present invention.

In accordance to another novel feature of the present invention, as shown in FIG. 15 and, a game display scoreboard 58 with a unique attachment to the enclosed trampoline and cage ball game structure 10 will be described. The scoreboard 58 has a front surface and a rear surface. Note that the front surface for example, can show a time clock display 59, a home team score display 60 and a visitor team score display 61 merely for illustration purposes. It is apparent that other display types, such as fouls or penalties, players' names and jersey numbers, periods or quarters, to name just a few, can be utilized as well, if desired. The rear surface includes a securing attachment (not shown) that slides on the second short pipe 32 within the at least one of the aforementioned spaces 41*a* created by the width of the cross joints 53 and the ends of the display banners 41 adjacent the cross joints 53 for tightly securing the scoreboard 58 on the second short pipe. This securing attachment (not shown) can take on various types of mechanical fastening means, if desired. As illustrated the scoreboard 58 is equal to the height of the display banners 41, 42. The scoreboard 58 has a plastic case around it for protection. This can provide safety protection for players or participants and prevent damage to the scoreboard 58. The scoreboard 58 is preferably operated by electrical power. However, the scoreboard 58 could be wireless or battery operated, if desired. The power cord 52 for the scoreboard is feed through a selective positioned hole in at least one of the intermediate elongated pipes 24 above the base plate 46 and upward through the elbow joint 39 at the top end portion of the least one of the intermediate elongated pipes 24 and through the third horizontal pipe 26. The power cord 52 is continued to be feed through the third horizontal pipe 26 via the three-way 45 degree joint 40 and along the brace support pipe 30 and through the first and second short pipes 31, 32 to the scoreboard 58. Note that the power cord 52 could be feed through the at least other one of the intermediate elongated pipe 24 through a hole spaced above the base plate 46 and into the other brace support pipe 30. The power cord 52 is continued to be feed into the first short pipe 31 extending from the brace support pipe 30 and through the second short pipe 32 that is attached to the first short pipe 31 and to the scoreboard 58, if desired. Other ways of feeding the power cord could be utilized, if desired.

Figure 16:
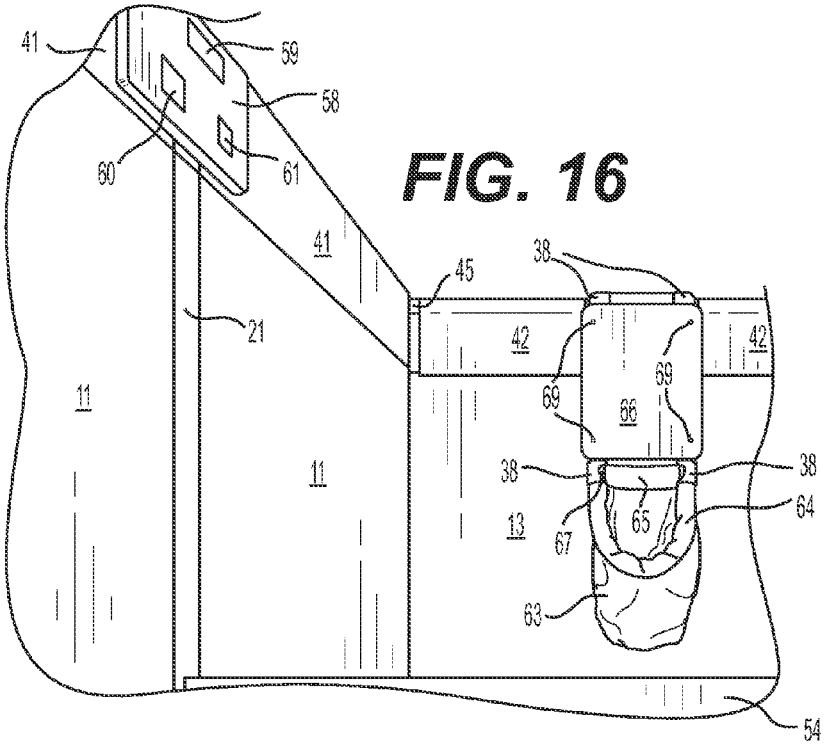
FIG. 16 illustrates a cutaway perspective view of a middle net, a scoreboard attached and positioned at the same height as the display banners above the intermediate reinforced seam of a side wall panel section and the middle net and a goal and backboard disposed along a display banner above an end wall panel section within an enclosed trampoline and cage ball game structure of the present invention.
Figure 17:
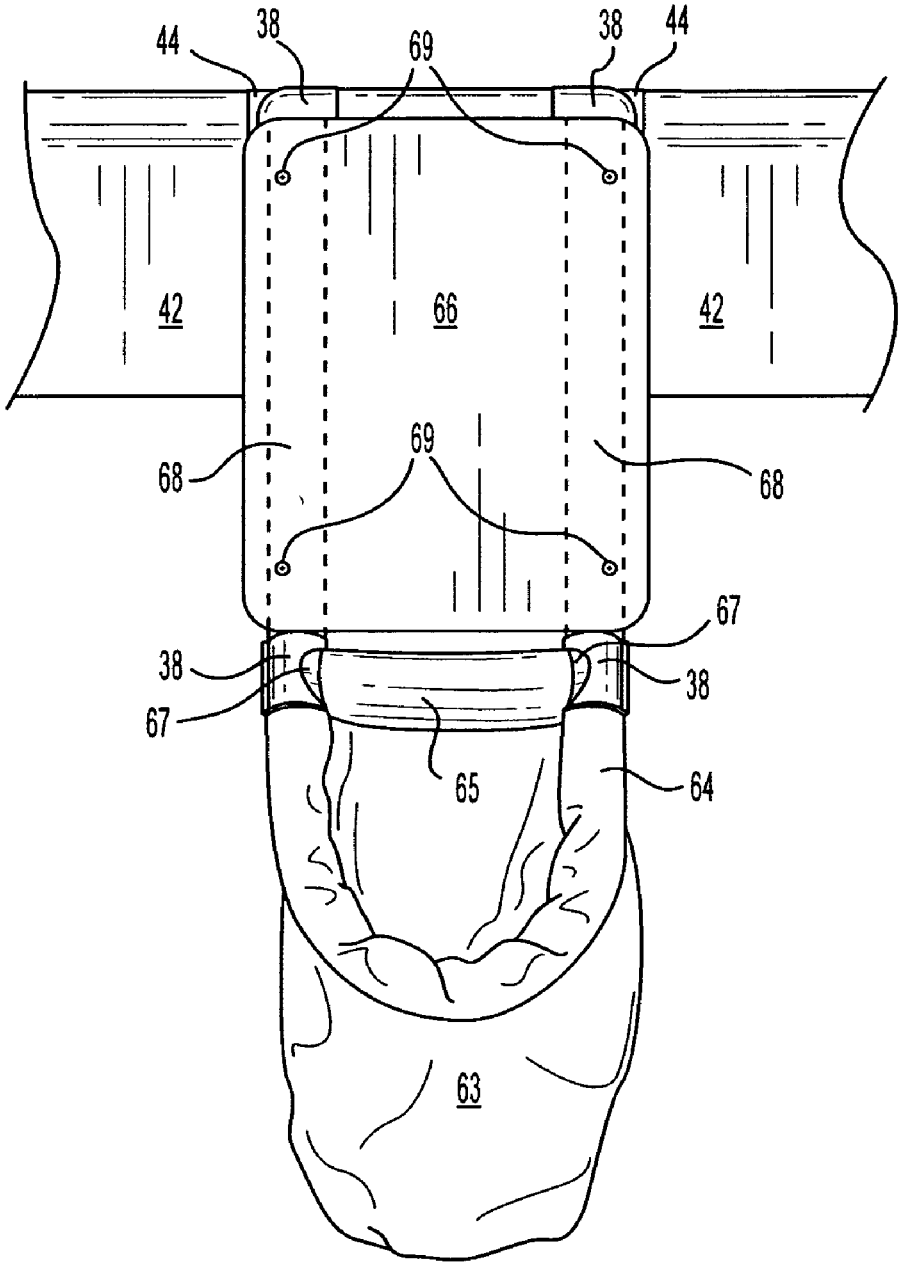
FIG. 17 illustrates a perspective front view of a backboard, goal and net in relationship to a partial view of a display banner above an end wall panel section according to the present invention.

In reference to FIGS. 16 and 17, another important feature of the present invention includes, a pair of goals 63, 66, similar to basketball type goals that is attached to the pair of sixth horizontal pipes 44 via a pair of spaced intermediate tee joints 38 having a straight portion with a pair of open ends that slides along the pair of sixth horizontal pipes 44. Each of the goal frame structures comprises a pair of pipe extensions (not shown) having one end connected directly to the straight portion of the intermediate tees 38 and the other perpendicular open end portion that forms the T-shape is attached to an upper open end of a three-way joint 45 (not shown), a lower open end of the three-way joint 45 (not shown) is attached directly to an elongated U-shaped tubular pipe 68 and the perpendicular open end portions of the three-way joints 45 (not shown) are attached to a first cross support pipe (not shown) at its open ends. Also, spaced below the first cross support pipe is a pair of tee joints 38 slidable and removably secured along the U-shaped tubular pipe 68 that is connected to a second cross support pipe 67 opposite open ends. From the bottom of a U-shape section of the tubular pipe 68 up to the second cross support pipe 67 forms a goal or hoop opening within net 63. As illustrated the goal frame structure is angled or slightly tilted downward.

Once the goal frame structures have been assembled, a backboard 66 is attached to the first pair of pipe extensions (not shown) and extending along the U-shaped tubular pipe 68 downward to and just above the second cross support pipe 67. The backboard 66 covers the entire U-shaped tubular pipe 68 down to the second cross support pipe 67. If desired, the backboard 66 can extend slightly beyond the U-shaped tubular pipe 68. The backboard 66 is secured to the U-shaped tubular pipe 68 downward to and just above the second cross support pipe 67 by screw means 69 or any other mechanical fastening means, if desired.

A goal or hoop net 63 having a rim portion 64 that is secured about the U-shape section and a flap or extension portion 65 is secured about the second cross support pipe 67. Note that the net rim portion 63 can be stitched thereon or they can be removably snapped thereon, to name just a few ways to attach the net rim portion 63 to the U-shaped section. It is apparent that various other ways of attaching the net to the U-shaped section and the second cross support pipe can be utilized, if desired.

Turning now to FIG. 15, another important feature of the present invention includes a lighting fixture 62 that is attached directly to the aforementioned intermediate tee joint 38 located on the third horizontal pipe 26 to provide adequate lighting to the two equally 6'×6' sections of the enclosed trampoline and cage ball game device 10 divided by the previously discussed middle net 54 during night-time participation or during poor visibility. Note that the lighting fixture 62 could be electrically or battery operated Finally, the aforementioned pipes 24-34, and 44 are preferably made of strong aluminum materials. However, other types of materials such as different types of plastics and metals, such as steel, to name just a few could be utilized, if desired. In reference to the U-shaped tubular goal structure 67, 68, it can be made from a flexible plastic tubing or spa hose covered with a padded neoprene for safety purposes. The net 63 is preferably made of some kind of nylon fabric. However, conventional net material used for other sporting games can be utilized, if desired. The ball utilized in the disclosed trampoline and cage ball game device 10 is preferably a vinyl type ball similar to a soccer ball filled with small cut up pieces of soft flexible hose or tubing therein. Note that the ball is not shown and is not considered the novelty of the present invention.

The size and dimensions of the components for the disclosed trampoline and cage ball game device structure 10 are as follows:

1) The corner pipes and the intermediate elongated pipes are at 16'-6".
2) The first and second horizontal pipes are at 8'.
3) The third horizontal pipe is at 13'-7".
4) The fourth horizontal pipes are at 12'.
5) The fifth horizontal pipes are at 7'-7".
6) The sixth horizontal pipes are at 5'-10".
7) The brace support pipe is at 57'.
8) The goal frame U-shape pipe is at 33".
9) The goal frame short pipe extensions are at 7".
10) The goal frame first and second cross support pipes are at 10".
11) The backboard is at 14"-29".

Note that these sizes and dimensions can vary, if desired. The other components not recited can vary in sizes as well.

While the foregoing written description of the invention enables one of ordinary skill in the art to make and use what is considered presently to be the best mode thereof, those of ordinary skill will understand and appreciate the existence of variations, combinations, and equivalents of the specific embodiment, method, and examples herein. The invention should therefore not be limited by the above described embodiment method, and examples, but by all embodiments and methods within the scope and spirit of the invention as claimed.

What is claimed is:

1. A trampoline and cage ball game device comprising:

a trampoline frame structure with a spring supported flexible trampoline bed attached thereto;

a plurality of support legs for supporting the trampoline frame and flexible bed;

a single continuous open ended sheet of flexible material that is folded into four reinforced corners defining a pair of end wall panel sections and a pair of side wall panel sections forming an enclosed cage structure, wherein each reinforced corner comprises horizontal lengths of the single continuous sheet of flexible material are folded to double over upon itself so that a plurality of layers of the flexible material forms each reinforced corner fold;

a plurality of elongated corner pipes attached to inner corners of the trampoline frame structure extending beyond the top of the enclosed cage structure, the corner pipes having first spring attachments secured between the plurality of elongated corner pipes and the four reinforced corner folds to stretch the enclosed cage structure at the end wall panel sections;

a plurality of intermediate stabilizing elongated pipes are positioned at locations in between and further outward of the plurality of corner pipes to allow the pair of side wall panel sections of the enclosed cage structure to be fully stretched further outward relative to the trampoline frame structure to maintain and prevent the pair of side wall panel sections of the enclosed cage structure from collapsing inward by second spring attachments extending between the plurality of intermediate elongated pipes and an intermediate reinforced seam extending substantially along the entire vertical length of each of the pair of side wall panel sections of the enclosed cage structure; and a plurality of stabilizing pipes selectively positioned between the plurality of corner pipes and pairs of the stabilizing pipes being oriented and extended at an angle away from the side wall panel sections between the intermediate elongated pipes and the corner pipes via an offset connector on the corner pipes and a swivel connector on the intermediate elongated pipes to achieve greater stability and balance of the trampoline frame and enclosed cage structures.

2. The trampoline and cage ball game device according to claim 1, wherein a top end of the corner pipes are connected together at each end by a pair of elbow connectors.

3. The trampoline and cage ball game device according to claim 1, wherein a top end of the corner pipes are connected together by an end horizontal pipe at each end by a pair of elbow connectors and the intermediate stabilizing pipes are joined together across the top at each end by an intermediate horizontal pipe via elbow connectors.

4. The trampoline and cage ball game device according to claim 3, wherein a first pair of horizontal display pipes extending between the end horizontal pipes of the corner pipes and connected thereto by a T-connector and spaced at a selected distance above the top of the side panel sections, and a second pair of horizontal display pipes extending parallel to the end horizontal pipe of the corner pipes and spaced there from and selectively positioned above a top end of the end wall panel sections and connected between the first pair of horizontal display pipes by a T-connector at each end.

5. The trampoline and cage ball game device according to claim 4, wherein a cross joint coupler having two connecting ends that are each connected to one end of the first pair of horizontal display pipes opposite the end horizontal pipes of the elongated corner pipes.

6. The trampoline and cage ball game device according to claim 5, wherein a brace support pipe having one end that is connected to one coupling opening of a first three-way 45 degree joint, with the other two coupling openings thereof slidably receiving the intermediate horizontal pipe there through, a second three-way 45 degree joint having a first opening positioned and in cooperation with the cross joint coupler, a second coupling opening being connected to the other end of the brace support pipe and the third coupling opening is connected to the intermediate horizontal display pipe and an intermediate three-way 45-degree joint having two open ends for slidably receiving the brace support pipe there through and the other end thereof is connected to an L-shaped pipe that substantially extends upward forming a 90 degree angle.

7. The trampoline and cage ball game device according to claim 6, wherein the L-shaped pipe extends upward into a space created by width of the cross joint coupler and the ends of the display banners for supporting and slidably receiving a display scoreboard thereon and position over the cross joint coupler and a portion of the banners adjacent thereto.

8. The trampoline and cage ball game device according to claim 7, wherein a power cord for the scoreboard may be hidden by at least routing it through a selective opening in at least one of the intermediate elongated pipes above a base plate that secures the intermediate and corner pipes to a ground surface or the like, then continuing through the intermediate elongated pipes through the first three-way 45 degree joint, through the L-shaped pipe and to the scoreboard.

9. The trampoline and cage ball game device according to claim 6, wherein the brace support pipe includes a metal tab secured thereto and is in abutting engagement with the second three-way connector that is positioned and in cooperation with the cross joint coupler, the metal tab having a portion that is secured to the brace support pipe by mechanical fasteners and an end that extends away from the brace support pipe includes a mounting hole therein for allowing pulleys to be attached to a harness so that a spotting training rig device can be easily attached and removed there from when the middle net is removed from the enclosed cage structure.

10. The trampoline and cage ball game device according to claim 4, wherein the first and second pair of horizontal display pipes slidably receives display banners thereon, wherein the selected distances above the top of the side wall panel sections and the top end of the end wall panel sections allows for display banners having a dimension that extend downward to the top of the side wall panel sections and end wall panel sections so they can be easily stitched thereto.

11. The trampoline and cage ball game device according to claim 4, wherein a pair of basketball type goals are attached to the second pair of horizontal display pipes via a first pair of spaced apart intermediate tee joints with a pair of open ends that slide along the second pair of horizontal display pipes, each of the goals include a U-shaped tubular pipe with a cross support pipe that is connected across the U-shaped tubular pipe for forming a goal or hoop opening and a net member having a rim portion is secured about the U-shaped tubular pipe and a flap or extension is secured about the cross support pipe.

12. The trampoline and cage ball game device according to claim 11, wherein a backboard structure is attached to the pair of longitudinal extension pipes and extending downward there along above the cross support pipe by fastening means.

13. The trampoline and cage ball game device according to claim 3, wherein the intermediate horizontal pipe includes a lighting fixture attached thereto.

14. The trampoline and cage ball game device according to claim 3, wherein the enclosed cage structure includes reinforced rods inserted through spaced openings along each of the respective intermediate reinforced seams substantially along the entire vertical length of the side wall panel sections forming gaps between the rods and respective reinforced seams for securing a middle net across the trampoline frame and enclosed cage structure.

15. The trampoline and cage ball game device according to claim 14, wherein the middle net is tightened and adjustably positioned within the enclosed cage structure by inserting a fastening means in the gaps between the reinforced rods and the seams and pulling the fastening means around the rods to securely fasten the middle net in the trampoline frame and enclosed cage structure.

16. The trampoline and cage ball game device according to claim 14, wherein the fastening means is a plurality of hook and loop type fasteners that are secured adjacent a peripheral edge of the middle net in proximity to the reinforced seams.

17. A trampoline and cage ball game device comprising:

a trampoline frame structure with a spring supported flexible trampoline bed attached thereto;

a plurality of support legs for supporting the trampoline frame and flexible bed;

a flexible material that is folded into four reinforced corners defining a pair of end wall panel sections and a pair of side wall panel sections forming an enclosed cage structure, wherein each reinforced corner comprises horizontal lengths of the flexible material folded to double over upon itself so that a plurality of layers of the flexible material forms each reinforced corner fold;

a plurality of elongated corner pipes attached to inner corners of the trampoline frame structure extending beyond the top of the enclosed cage structure, the corner pipes having first spring attachments secured between the plurality of elongated corner pipes and the four reinforced corner folds to stretch the enclosed cage structure at the end wall panel sections;

a plurality of intermediate stabilizing elongated pipes are positioned at locations in between and further outward of the plurality of corner pipes to allow the pair of side wall panel sections of the enclosed cage structure to be fully stretched further outward relative to the trampoline frame structure to maintain and prevent the pair of side wall panel sections of the enclosed cage structure from collapsing inward by second spring attachments extending between the plurality of intermediate elongated pipes and an intermediate reinforced seam extending substantially along the entire vertical length of each of the pair of side wall panel sections of the enclosed cage structure; and a plurality of stabilizing pipes selectively positioned between the plurality of corner pipes and pairs of the stabilizing pipes being oriented and extended at an angle away from the side wall panel sections between the intermediate elongated pipes and the corner pipes via an offset connector on the corner pipes and a swivel connector on the intermediate elongated pipes to achieve greater stability and balance of the trampoline frame and enclosed cage structures.

* * * * *